US006698120B2

(12) United States Patent
Bundy

(10) Patent No.: US 6,698,120 B2
(45) Date of Patent: Mar. 2, 2004

(54) SCHEDULING SIGN SYSTEM

(76) Inventor: William J. Bundy, 736 Eddy Rd., Crownsville, MD (US) 21032-1719

( * ) Notice: Subject to any disclaimer, the term of this patent is extended or adjusted under 35 U.S.C. 154(b) by 66 days.

(21) Appl. No.: 09/773,482

(22) Filed: Feb. 2, 2001

(65) Prior Publication Data

US 2001/0023548 A1 Sep. 27, 2001

Related U.S. Application Data

(60) Provisional application No. 60/180,160, filed on Feb. 4, 2000.

(51) Int. Cl.[7] ..... G09F 19/00

(52) U.S. Cl. ..... 40/446; 40/110; 116/329

(58) Field of Search ..... 40/110, 600, 595, 40/594, 446; 116/329, 223, 309, 316; 283/37

(56) References Cited

U.S. PATENT DOCUMENTS 304,281 A * 8/1884 Russell ..... 116/329
445,484 A * 1/1891 Wheeler ..... 40/110
1,156,345 A * 10/1915 Burnap
1,868,430 A * 7/1932 Pla Costa ..... 40/110
2,685,860 A * 8/1954 Plakas
2,761,413 A * 9/1956 Breer ..... 116/329
3,001,308 A * 9/1961 Potter ..... 40/110
3,919,796 A * 11/1975 Shimazaki ..... 40/110
3,975,848 A * 8/1976 Schmid ..... 40/110

FOREIGN PATENT DOCUMENTS

CH 672203 * 10/1989 ..... 40/508

* cited by examiner

*Primary Examiner*—Joanne Silbermann
(74) *Attorney, Agent, or Firm*—Fitzpatrick, Cella, Harper & Scinto

(57) ABSTRACT

A scheduling sign system includes a main sign, at least one entity indicator, and at least one alternative indicator. The main sign displays an array of units of time. The entity indicator, which is separate from the main sign, displays information identifying an entity, e.g., a person. The alternative indicator, which is separate from the main sign and the entity indicator, displays information identifying a location, reminder, appointment, or activity, e.g., a scheduled doctor's appointment. The entity indicator indicates (e.g., points to) either a particular time on the main sign, e.g., the time of the doctor's appointment, or a particular alternative indicator. The alternative indicator indicates (e.g., points to) a particular time on the main sign or a particular entity indicator.

18 Claims, 5 Drawing Sheets

SCHEDULING SIGN SYSTEM

BACKGROUND OF THE INVENTION

There are signs available that may be used to indicate the time of the day at which a user of the sign intends to return. Most commonly, these signs are used by office workers or storekeepers who need to indicate to other employees or customers when they will return to their posts. Such a sign typically is printed with a statement that the user intends to return (i.e., "Will Return At:"), and is designed so that the user can indicate on the sign a time at which he or she intends to return.

To indicate the time of return, the sign usually has a representation of a clockface and movable clock-like hands that are rotatably secured to the center of the clockface. However, the clock-like hands do not automatically move, as on a working clock. Instead, the hands are manually positioned by the user so as to indicate on the clockface the time at which the user will return. Once positioned, the hands will stay in the set position until manually moved by the user (or another individual).

For instance, if a storekeeper is going to leave for lunch and intends to return to the store at 1:30, the storekeeper would position one hand on the sign to point to the one o'clock position and the other hand to point to the 30 minute position. Thus, the sign would indicate that the storekeeper "Will Return At: 1:30."

Examples of such conventional signs are described in U.S. Pat. Nos. 620,315 and 1,584,559. There are also known variations of these signs that allow the names of multiple individuals to be mounted on a sign in order to indicate the return times of different individuals. For instance, such conventional signs may include a plurality of clockfaces on a single sign, or a plurality of different clock-like hands, for different users, which are securely mounted on a single clockface of the sign. Examples of such variations are described in U.S. Pat. Nos. 119,891 and 2,687,705.

However, the conventional signs do not provide a simple system for indicating the return times of more than one person. These signs also do not provide a simple system for indicating different locations or activities from which various individuals will return, and are not adaptable to provide information pertaining to the times of events or appointments. Accordingly, there is a need for a simple time-based sign system that provides greater flexibility in the information that can be provided and the manner in which it is provided.

SUMMARY OF THE INVENTION

The present invention is directed to a scheduling sign system that is simple, but can provide a greater range of information than conventional "return at" signs and thus is useful in a great number of settings, such as a home.

According to a first aspect of the present invention, the scheduling sign system includes a main sign and a plurality of entity indicators. The main sign displays an array of units of time. The plurality of entity indicators, each of which is separate from the main sign and positionable adjacent the main sign, display information identifying an entity. The entity indicators indicate units of time on the main sign.

In a second aspect of the present invention, the scheduling sign system includes a main sign, at least one entity indicator, and at least one alternative indicator. The main sign displays an array of units of time. The at least one entity indicator, which is separate from the main sign, displays information identifying an entity. The at least one alternative indicator, which is separate from the main sign and the entity indicator, displays information identifying at least one of a location, reminder, appointment, and activity. The entity indicator indicates a unit of time on the main sign or an alternative indicator. The alternative indicator indicates a unit of time on the main sign or an entity indicator.

Preferably, the sign system includes a plurality of the entity indicators and a plurality of the alternative indicators. It is also preferred that each of the entity indicators and alternative indicators include a pointer. Accordingly, the entity indicators may indicate a unit of time or an alternative indicator by pointing, and the alternative indicators may indicate a unit of time or an entity indicator by pointing.

In a third aspect of the present invention, the scheduling sign system includes a main sign and a plurality of indicators. The main sign displays an array of units of time. The plurality of indicators display activity, reminder, appointment, location, or entity information. The indicators are separate from and positionable adjacent to the main sign, and indicate units of time on the main sign by pointing to positions on the main sign. The information displayed on the indicators is alterable by a user.

With these embodiments of the present invention, the sign system may be used to indicate a wide range of information in a simple manner. For instance, the entity indicators may be used to point to times on the main sign in order to indicate the times at which different individuals represented by the different entity indicators will return. The alternative indicators may be used to point at entity indicators in order to indicate from which activities or locations the indicated individuals are to return.

Also, the sign system may be used to indicate times at which different individuals need to be picked up (i.e., children to be picked up from sports practices). In that case, an entity indicator may display the identity of an individual to be picked up, and an alternative indicator may display the location from which that individual is to be picked up. Accordingly, the entity indicator may point to a time on the main display and the alternative indicator may point to the entity indicator, or vice versa.

Of course, the sign system may be used to display other combinations of information as needed by the user. For instance, the indicators may be used in conjunction with the main sign to indicate times at which chores are to be performed, activities are to take place, or medicines are to be taken/administered, as well as the individuals associated therewith.

The Main Sign

Preferably, the main sign of the sign system is circular and includes a representation of a conventional, circular clockface. Accordingly, the units of time displayed thereon may be hours (and perhaps minutes) of a day, which may be arranged substantially around the circumference of the clockface. However, variations of the traditional twelve-hour clock face may also be used. For instance, a circular clockface displaying 24 hours may be used in order to display both the A.M. and P.M. hours of a single day. Alternatively, instead of displaying A.M. and P.M. hours (i.e., two twelve-hour cycles), the clockface may display the hours of the day in "military time" (i.e., a twenty-four-hour cycle).

In addition, the clockface and/or main sign may have a shape other than circular. For instance, the sign may be provided with a linear representation of a clockface, in which case the sign is preferably rectangular. In such an embodiment, for example, the numbers representing the hours of the day may be arranged in a substantially straight line along the top or bottom of a ruler-shaped component. Preferably, the numbers would be arranged on both the top and bottom of the ruler shape, with the different sides representing the A.M. and P.M. hours, respectively.

In other embodiments, the units of time displayed on the main sign may be other than hours and minutes. For instance, the main sign may display the days of the week. Accordingly, the sign system may be used to indicate chores, activities, or other events that are to take place or be performed during a given week, and may also indicate the individuals associated with the particular events.

The displayed units of time may be varied in other ways to suit the particular needs of the user, such as providing the days of a month. In addition, the arrangement or representations of the information displayed on the main sign may be varied as necessary to make the sign more user friendly. Accordingly, a wide range of shapes and layouts may be employed for the main sign.

The main sign may also display additional information for users, other than just time information. For instance, the main sign may display information pertaining to whether the indicated time is a time at which an individual will return or a time at which he or she should be picked up. In other embodiments, the main sign may have areas in which a user may provide his or her own additional information, for instance, by writing on an erasable area or paper tablet.

The Indicators

Unlike traditional "return at:" signs, the indicators of the present invention are removable so that they may be placed at different positions with respect to the main sign. The indicators may be positioned on or adjacent to the main sign, and still clearly indicate times. For instance, the indicators may be placed inside or outside the circumference of a traditional clockface, while still pointing at specific times. By placing the indicators adjacent to the main sign, areas on the main sign are available for displaying other information. For instance, if the sign is to be used in conjunction with an advertisement, logos or other advertisement information may be displayed on the main sign.

Preferably, the indicators are shaped like clock hands or arrows, so that the indicators may clearly point to times on the main sign. In addition, multiple indicators are provided for a single main sign so that the sign system may be used simultaneously by different individuals, or to indicate simultaneously both entity and alternative (i.e., chore, location, activity, medicine, etc.) information.

Most preferably, a plurality of indicators will be provided that represent different entities. For instance, when three indicators are provided, the indicators may represent three different individuals, so that all three individuals may indicate their respective times of return by positioning their respective indicators to point to units of time displayed on the main sign. Alternatively, the entity indicators may represent pets, groups, etc.

Preferably, the indicators are pre-printed with generic designations, in order to distinguish between the different users who intend to use the sign. For instance, when the sign is used in a family setting, the indicators may be printed with terms such as "Father," "Mother," "Brother," and "Sister." However, the indicators may also be blank so that users can personalize the indicators as they choose. Users may personalize the indicators by writing on the indicator (preferably on easily erasable areas), or, in other circumstances, the indicators may be adapted to mount personalized cards or paper containing personalized information.

In addition to entity indicators for representing individuals, pets, or groups, the present invention may also include movable alternative indicators that may display information pertaining to locations, appointments, events, or activities. For instance, the alternative indicators may provide information pertaining to a chore to be performed, medicine to be taken/administered, a sporting event, a doctor's appointment, etc. These alternative indicators are preferably used in conjunction with the entity indicators. Specifically, once an entity indicator is placed on or near the main sign, so as to indicate a time pertinent to the represented entity, an alternative indicator may be placed in conjunction with the entity indicator (preferably so as to point toward the entity indicator) in order to provide information regarding the location, appointment, event, or activity pertinent to that entity at the indicated time. Or, if preferred, the alternative indicators may point directly at times on the main sign to provide time information relevant to the activity, event, etc. If needed, one or more entity indicators may then be used to point at the alternative indicator to provide additional information.

The shape and specific features of the alternative indicators may vary in ways similar to those discussed above with respect to the entity indicators. In addition, the alternative indicators may be preprinted with relevant information, or a user may provide the information on a blank indicator, as described above with respect to the entity indicators.

Preferably, the different parts of the sign system (i.e., the main sign and indicators) are magnetic. Accordingly, the magnetic pieces may be removably secured to a refrigerator, or other ferromagnetic surface. Also, the magnetic indicators may be removably secured to the main sign itself. Of course, other types of methods may be used to hang the main sign and indicators, such as hook-and-loop fasteners (e.g., Velcro® brand fasteners) or adhesive coatings/materials.

DETAILED DESCRIPTION OF THE DRAWINGS

Figure 1:
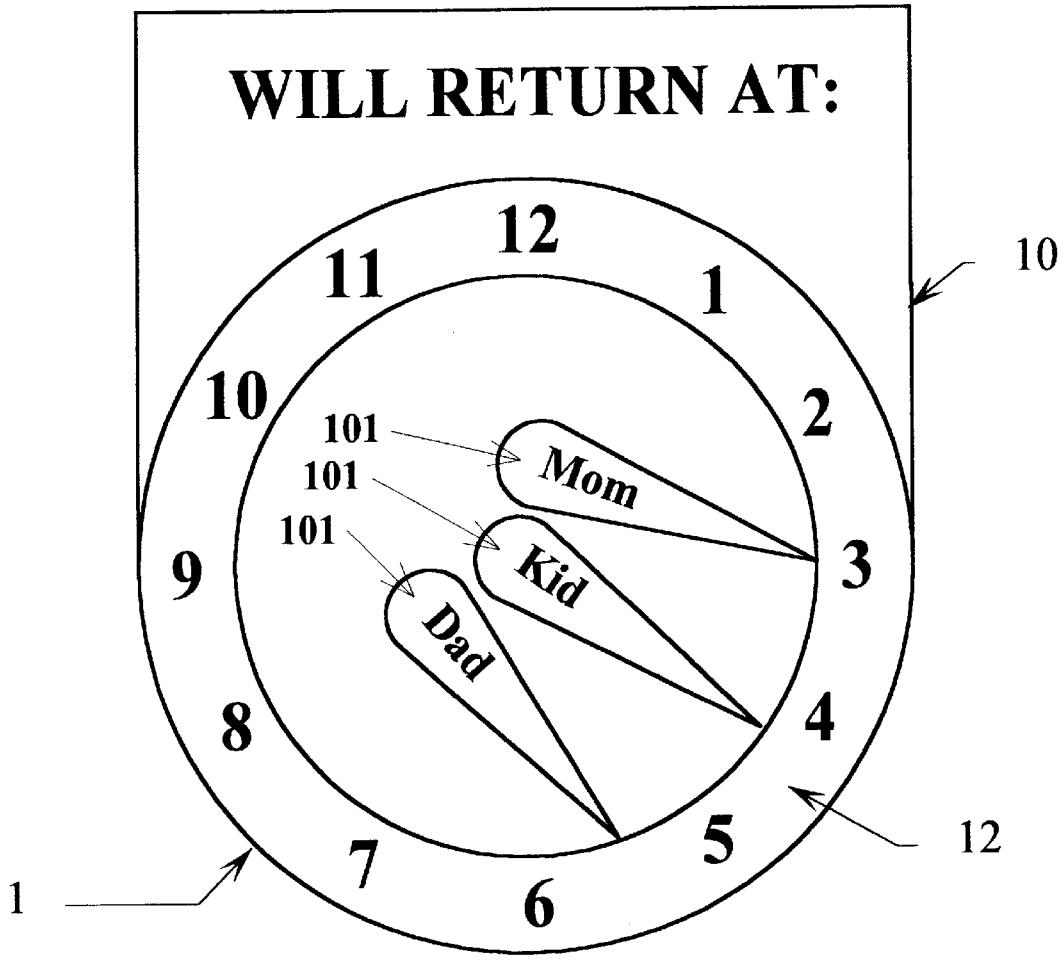
FIG. 1 shows a sign system of the present invention having a conventional twelve-hour clockface and entity indicators.

One embodiment of the present invention is shown in FIG. 1. FIG. 1 shows a "return at:" type sign system 1 in which a circular twelve-hour clockface 12 is provided on a main sign 10. The sign system 1 includes three entity indicators 101, with each indicator displaying information representing a different individual (i.e., "Dad," "Mom," and "Kid"). The entity indicators 101 are positioned inside the circumference of the clockface 12 and point outward to different times represented on the clockface 12. The phrase "Will Return At:" is displayed on the main sign 10 outside the clockface 12.

Figure 2:
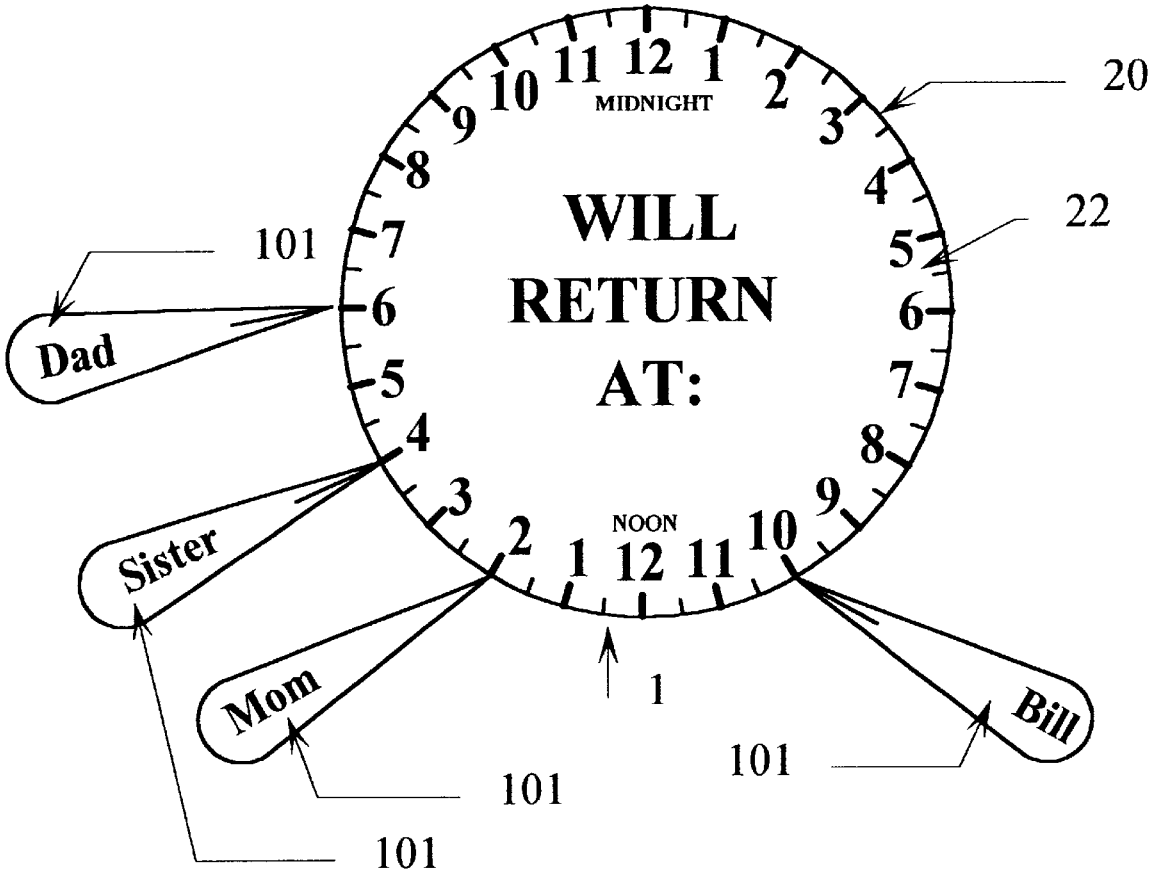
FIG. 2 shows a sign system of the present invention having a circular, twenty-four-hour clockface and entity indicators.

FIG. 2 shows a sign system 1 of another embodiment of the present invention that includes a main sign 20 displaying a circular twenty-four-hour clockface 22. In this embodiment, the units of time displayed on the clockface 22 begin at the top of the clockface with "Midnight" and proceed (through the A.M. hours) along a 180° portion of the circumference of the clockface 22 to "Noon." The numbers on the remaining 180° portion of the circumference of the clockface 22 start at the "Noon" position, and proceed chronologically (through the P.M. hours) back to the midnight position at the top of the clockface 22.

In FIG. 2, the entity indicators 101 are positioned outside of the circumference of the clockface 22, adjacent the main sign 20, so as to point inward at the specific return times for the entities. The entities/users are represented by identifying text on the indicators (i.e., "Dad," "Mom," "Sister," and "Bill"). The phrase "Will Return At:" is displayed on the main sign inside the circumference of the clockface 22.

Figure 3:
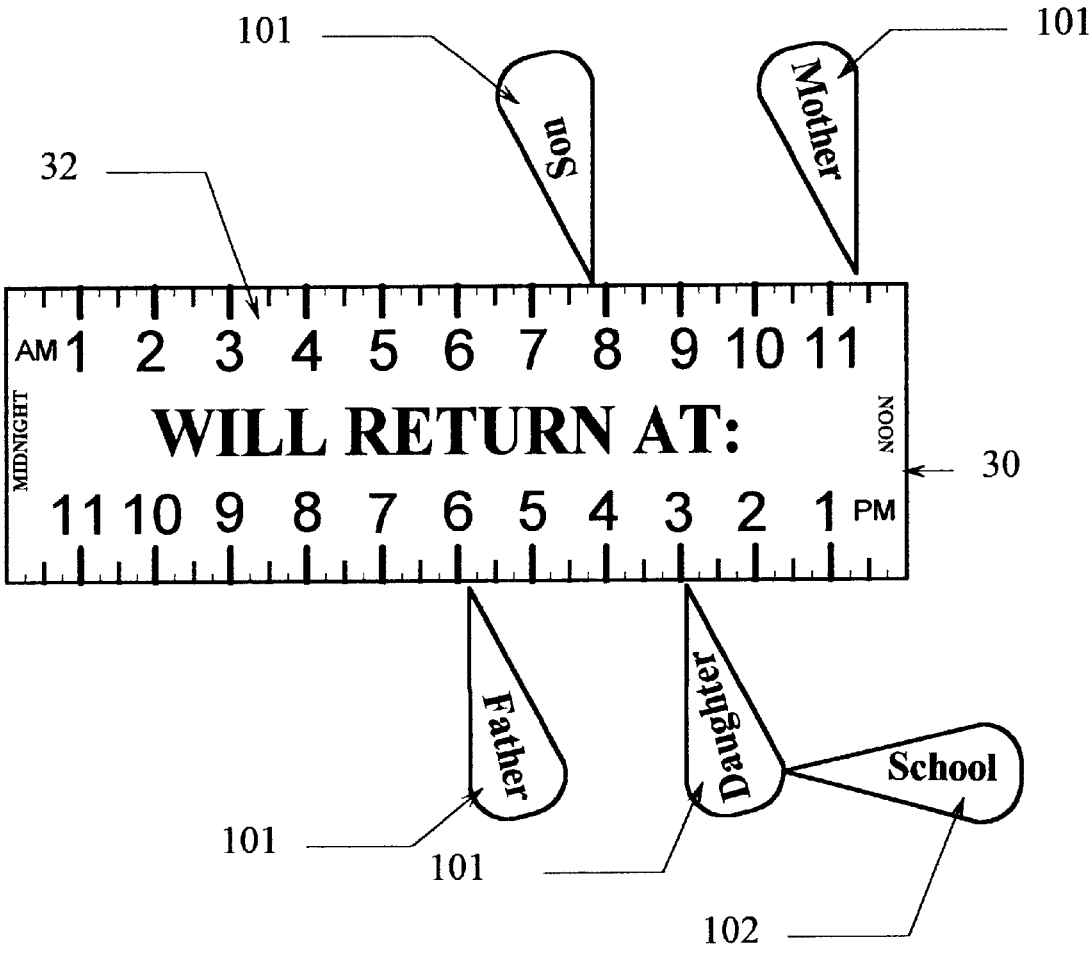
FIG. 3 shows a sign system of the present invention having a ruler-shaped clockface, entity indicators, and alternative indicators.

FIG. 3 shows a sign system 1 of another embodiment of the present invention that includes a rectangular main sign 30 displaying a representation of a clockface 30 arranged to mimic a ruler. Numbers representing the A.M. hours extend linearly along the ruler shape from the top left side of the main sign 30 to the top right side. The numbers representing the P.M. hours extend from right to left along the bottom of the main sign 30. On the right side of the main sign 30, the term "Noon" is printed in order to represent the change from the A.M. hours displayed on the top to the P.M. hours indicated on the bottom of the main sign 30. Similarly, on the left side of the main sign 30, the term "Midnight" is printed in order to represent the change from the P.M. hours on the bottom to the A.M. hours on the top. "Will Return At:" is displayed across the main sign 30, within a border formed by the numbers.

Movable entity indicators are positioned outside the clockface 32, adjacent the main sign 30, in order to point to the numbers arranged along the main sign 30. As in the other embodiments, terms are displayed on the entity indicators 101 in order to differentiate among the different entities/users (i.e., "Father," "Mother," "Daughter," and "Son").

In this embodiment, an alternative indicator 102 is also provided that has the term "School" displayed on it. The alternative indicator 102, rather than pointing at a time on the clockface 32, is positioned so as to point at the entity indicator 101 labeled "Daughter." Thus, in addition to indicating the times at which the different individuals will return, the sign system 1 shown in FIG. 3 indicates the location from which the "Daughter" will return at the indicated time of 3:00 P.M.

Figure 4:
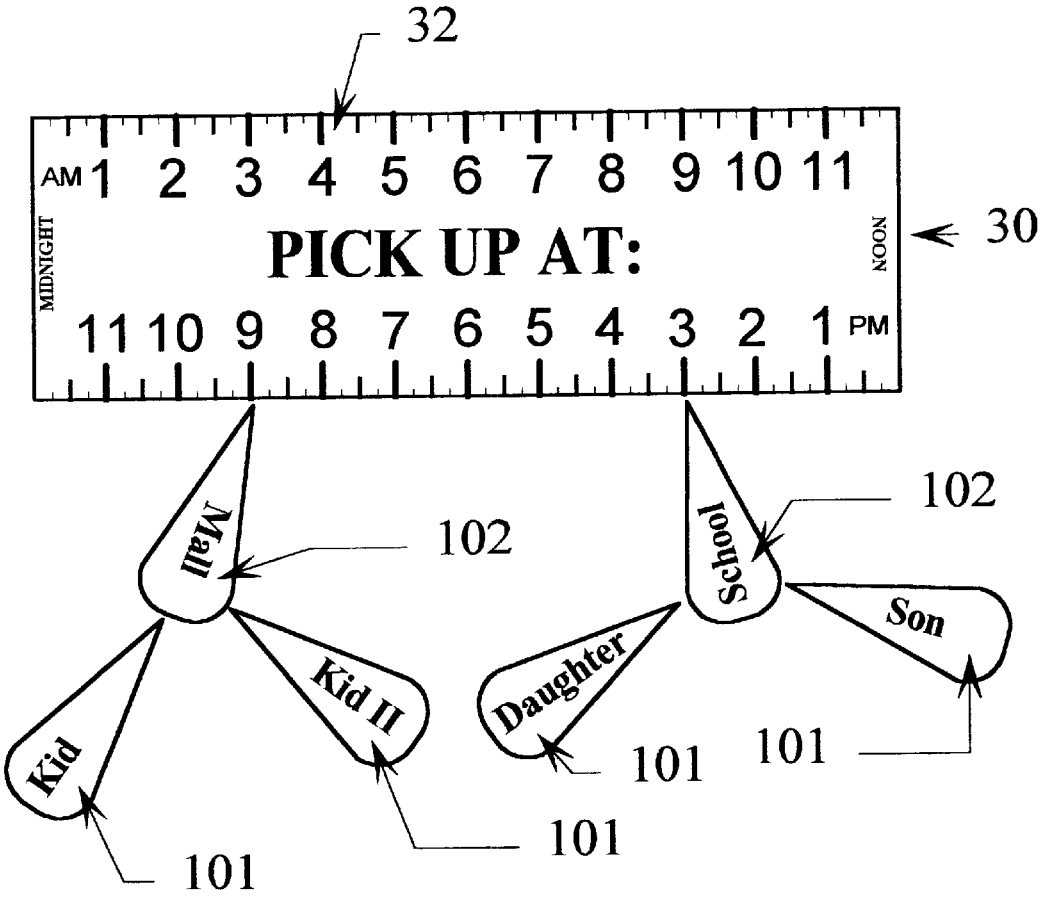
FIG. 4 also shows a sign system of the present invention having a ruler-shaped clockface, entity indicators, and alternative indicators.

FIG. 4 shows a variation of the sign system 1 shown in FIG. 3. Specifically, on the clockface 30 shown in FIG. 4, instead of displaying the phrase "Will Return At:," the phrase "Pick Up At:" is provided in its place. Alternative indicators 102, representing locations (i.e., "Mall" and "School"), are positioned so as to point to times on the clockface 32. Thus, instead of indicating when particular individuals will return, the sign system 1 is used to indicate times at which individuals need to be picked up from the indicated locations.

Entity indicators 101 (i.e., "Kid," "Kid II," "Daughter," and "Son") are positioned so as to point toward the alternative indicators 102, in order to indicate the individuals that need to be picked up from the indicated locations.

Figure 5:
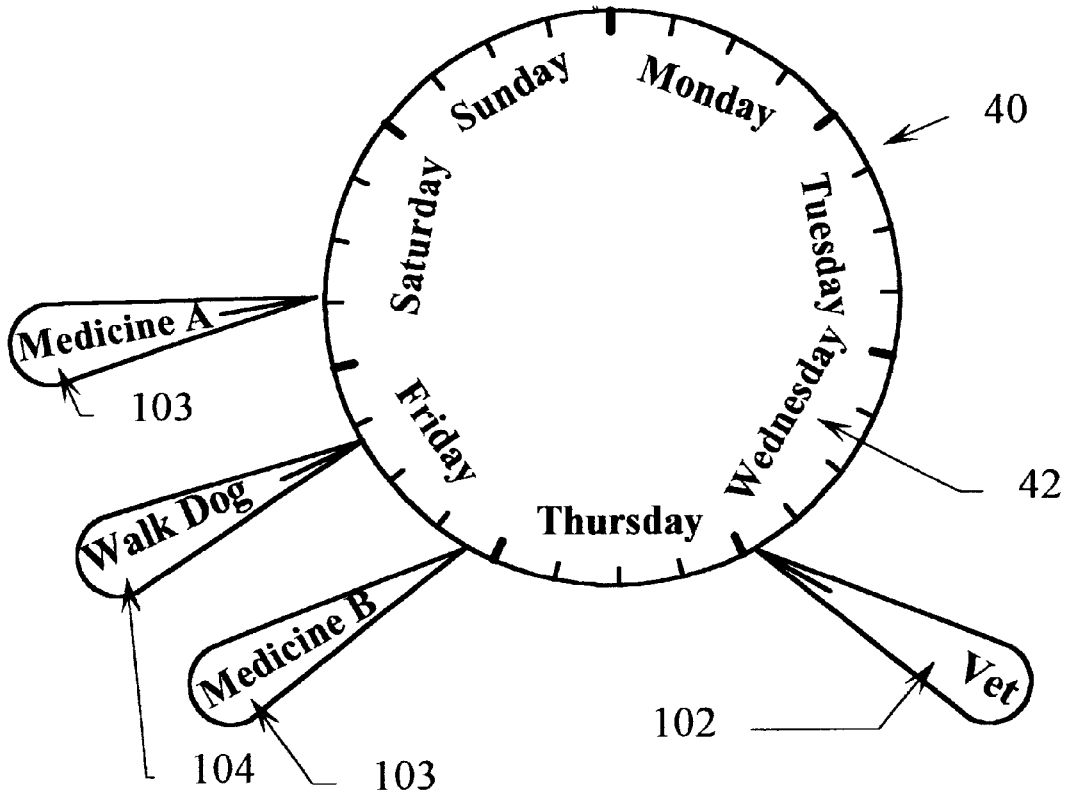
FIG. 5 shows a sign system of the present invention having the days of the week and alternative indicators.

FIG. 5 shows yet another embodiment of the present invention. In FIG. 5 there is depicted a sign system 1 in which a circular main sign 40 displays an array 42 of the days of a week around the circumference thereof. Indicators 102–104 are provided adjacent to the main sign 40 so as to point to the displayed days of the array 42, and also to general times during those days. Alternative indicator 102 indicates an appointment scheduled for, or a location to be at, on Wednesday (i.e., "Vet"). Alternative indicators 103 each indicate a medicine to be taken/administered (i.e., "Medicine A" and "Medicine B"). Alternative indicator 104 indicates a chore to be performed on Friday (i.e., "Walk Dog"). The center of the main sign 40 is blank, in order to allow space for notes by a user, a logo, an advertisement, etc.

These figures merely provide examples of preferred designs that may be used in keeping with the present invention. Of course, the invention is not intended to be limited by the specific embodiments shown in these figures.

I claim:

1. A scheduling sign system comprising:

a main sign displaying an array of units of time;

at least one entity indicator, removably securable to or adjacent the main sign, that has a pointer and displays information identifying an entity; and at least one alternative indicator, also removably securable to or adjacent the main sign, that is separate from said entity indicator, has a pointer, and displays information identifying at least one of a location, reminder, event, appointment, or activity, wherein the entity indicator (a) indicates a particular time on the main sign by being secured to or adjacent the main sign in such a position that it points to the particular time, or (b) indicates the at least one alternative indicator by being secured to or adjacent the main sign in such a position that its pointer is positioned adjacent and points to the alternative indicator, and the alternative indicator (i) indicates a particular time on the main sign by being secured to or adjacent the main sign in such a position that it points to the particular time, when the entity indicator indicates the alternative indicator and (ii) indicates the at least one entity indicator by being secured to or adjacent the main sign in such a position that its pointer is positioned adjacent and points to the entity indicator, when the entity indicator indicates the particular time.

2. A sign system according to claim 1, wherein the sign system comprises a plurality of the entity indicators and a plurality of the alternative indicators.

3. A sign system according to claim 2, wherein the entity indicators and the alternative indicators are capable of being arranged on the main sign when in use.

4. A sign system according to claim 2, wherein the information displayed on at least one of the entity indicators and the alternative indicators is preprinted on the indicator.

5. A sign system according to claim 2, wherein the information displayed on at least one of the entity indicators and the alternative indicators is alterable by a user.

6. A sign system according to claim 2, wherein the main sign, the entity indicators, and the alternative indicators are all magnetic.

7. A sign system according to claim 2, wherein said main sign, the entity indicators, and the alternative indicators all have adhesive backings for mounting.

8. A sign system according to claim 1, wherein the units of time displayed on the main sign consist of or include hours.

9. A sign system according to claim 8, wherein the main sign is circular and the hours of one day are arranged substantially along the circumference of the main sign.

10. A sign system according to claim 9, wherein the entity indicators and the alternative indicators are capable of being arranged outside the circular arrangement of the hours of one day.

11. A sign system according to claim 8, wherein the main sign is rectangular and the hours of one day are arranged in a substantially straight line along the main sign.

12. A sign system according to claim 8, wherein the main sign is rectangular and ante meridiem hours of one day are arranged along a first side of the main sign, and post meridiem hours of one day are arranged along a second side of the main sign.

13. A sign system according to claim 1, wherein the units of time arrayed on the main sign consist of or include days of a week.

14. A scheduling sign system comprising:

a main sign displaying an array of units of time in chronological order, with the array of units of time defining a boundary enclosing a predefined area;

a plurality of entity indicators, removably securable to or adjacent the main sign outside of the boundary defined by the array of units of time, each of which has a pointer and displays information identifying an entity, wherein the entity indicators indicate units of time on the main sign by being secured to or adjacent the main sign in such a position that they point to the units of time from positions located outside of the boundary defined by the units of time.

15. A sign system according to claim 14, wherein information displayed on at least one of the entity indicators is alterable by a user.

16. A sign system according to claim 14, wherein the main sign and the entity indicators are all magnetic.

17. A sign system according to claim 14, wherein the units of time are arrayed in a substantially circular pattern and the boundary is defined by the circumference of the circular pattern.

18. A sign system according to claim 14, further comprising a plurality of alternative indicators, capable of being removably securable to or adjacent the main sign outside of the boundary defined by the array of units of time, each of which has a pointer and displays information identifying at least one of a location, reminder, event, or appointment, wherein each of the alternative indicators is capable of (i) indicating a particular time on the main sign by being secured to or adjacent the main sign in such a position that it points to the particular time and (ii) indicating an entity indicator by being secured to or adjacent the main sign in such a position that it points to the entity indicator.

* * * * *